US007814946B1

(12) United States Patent
VanDusartz

(10) Patent No.: US 7,814,946 B1
(45) Date of Patent: Oct. 19, 2010

(54) HANDS FREE WOOD SPLITTER SYSTEM

(76) Inventor: Charlie VanDusartz, 1516 110th Ave., Hammond, WI (US) 54015

( * ) Notice: Subject to any disclaimer, the term of this patent is extended or adjusted under 35 U.S.C. 154(b) by 239 days.

(21) Appl. No.: 12/080,310

(22) Filed: Apr. 2, 2008

Related U.S. Application Data

(60) Provisional application No. 60/921,879, filed on Apr. 5, 2007.

(51) Int. Cl.
*B27L 7/04* (2006.01)

(52) U.S. Cl. ..... 144/4.6; 144/193.1; 144/193.2; 144/195.1

(58) Field of Classification Search ..... 144/4.6, 144/193.1, 193.2, 195.1, 195.5
See application file for complete search history.

(56) References Cited

U.S. PATENT DOCUMENTS

| | | | | |
|---|---|---|---|---|
| 3,670,789 | A | 6/1972 | Long | |
| 3,760,854 | A * | 9/1973 | Worthington | 144/195.1 |
| 3,993,113 | A | 11/1976 | Thackery | |
| 4,026,337 | A | 5/1977 | Thackery | |
| 4,132,255 | A * | 1/1979 | Thackery | 144/193.1 |
| 4,188,987 | A | 2/1980 | James | |
| 4,245,683 | A | 1/1981 | Cedergren | |
| 4,252,166 | A | 2/1981 | Kozicki | |
| 4,317,476 | A | 3/1982 | Radizik | |
| 4,335,762 | A | 6/1982 | Reaume et al. | |
| 4,425,950 | A | 1/1984 | Schnebly | |
| 4,491,164 | A | 1/1985 | Waikas et al. | |
| 4,553,576 | A | 11/1985 | Maingueneau | |
| 4,615,366 | A * | 10/1986 | Scarbrough, Jr. | 144/195.1 |
| 4,646,800 | A * | 3/1987 | Wentzell | 144/194 |
| 4,898,220 | A | 2/1990 | Maingueneau | |
| 6,408,907 | B1 | 6/2002 | Lantz | |
| 6,520,226 | B1 | 2/2003 | Smith | |
| 6,609,547 | B1 | 8/2003 | Machkovech | |
| 6,763,864 | B2 | 7/2004 | Stelack et al. | |
| 7,066,223 | B2 | 6/2006 | Stone | |

* cited by examiner

*Primary Examiner*—Shelley Self
(74) *Attorney, Agent, or Firm*—Tipton L. Randall

(57) ABSTRACT

An hydraulically powered implement attachment for a powered machine is disclosed. The implement attachment comprises a frame member adapted for attachment to at least one movable arm of the powered machine. A reversible drive hydraulic motor member is mounted to the frame member. The hydraulic motor member includes a drive shaft extending therefrom and a pair of hydraulic power lines adapted for attachment to the powered machine. A power shaft is rotatably mounted to the frame member and operatively connected at a first end to the drive shaft of the hydraulic motor member. A rotationally operative implement member is connected to a second end of the power shaft. An operator of the powered machine actuates the rotationally operative implement member through rotation of the power shaft by the reversible drive hydraulic motor. Preferably the implement attachment member is a conical wood splitter member and the powered machine is a skid steer.

4 Claims, 9 Drawing Sheets

FRONT END VIEW

"HANDS FREE WOOD SPLITTER"

HANDS FREE WOOD SPLITTER SYSTEM

CROSS-REFERENCE TO RELATED APPLICATIONS

This application claims the benefit under 35 U.S.C. §119 (e) of provisional application Ser. No. 60/921,879, filed 5 Apr. 2007. Application Ser. No. 60/921,879 is hereby incorporated by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to an implement system, such as a wood splitting system and, more particularly, to a remotely operated implement system, such as a wood splitting system and, most particularly, to a wood splitting system that employs a powered machine coupled to a rotatable conical wedge that splits wood at a location remote from the operator of the powered machine.

2. Background Information

The use of wood for heating and cooking dates from the early history of mankind. In order to provide pieces of wood that are readily handled by an individual, large logs are cut into smaller lengths. In order to more quickly dry the shorter log lengths, it is necessary to split these sections of log to expose the interior to the atmosphere. Splitting of log sections has been done manually for centuries, and requires great physical effort.

In recent times, mechanically operated wood splitters have been developed that employ various motors to drive a wedge through a log section to split it into smaller pieces. In general, the mechanical wood splitters require an individual to place a section of log between a wedge and a stationary support. The wedge is then mechanically driven toward the support to split the log into smaller pieces. The wedge then moves away from the support. The individual then places another log section between the wedge and the stationary support, and the process is repeated. Thus, the individual is in close proximity to moving machinery, which entails some risks.

One variation of a simple splitting wedge that recently gained favor is a conical wedge with a screw thread outer surface. The conical wedge is mounted to a powered shaft that rotates the conical wedge. Contacting the rotating conical wedge with a section of log causes the screw thread outer surface to draw the rotating conical wedge into the log section, thereby splitting the log section due to the increasing diameter of the advancing conical wedge. However, many injuries occurred when the individual operating the rotating conical wedge splitter became entangled with the wedge or power shaft during operation. Thus, such a rotating conical wedge log splitter can be a dangerous device when in operation. Some examples of conical wedge log splitters that have been granted patents include the following.

Long, in U.S. Pat. No. 3,670,789, describes a device for splitting logs. The device consists of an engine driven shaft having a conical screw thereupon to penetrate and split logs. The wood splitting apparatus includes a plurality of U-shaped channel members, which form the base of apparatus. A flat plate is secured to the top of one end of the channel members and provides support for the hollow rectangular housing and the engine. The drive shaft of the engine extends into the housing and is supported upon a bearing. Secured rigidly to the shaft is a sprocket. A shaft, parallel with the shaft, extends through the housing and is supported upon the bearings. Secured rigidly to the shaft is a sprocket, which is in alignment with the sprocket of the shaft. The sprockets carry an endless chain, which allows the shaft to rotate simultaneously with the engine shaft, when the apparatus is in operation. Exterior of the housing, a screw is secured to the shaft, which serves to split wood. A pair of adjacent channel members is provided with raised portions, which allows the log to be carried against the screw. In use, a log is split by the pointed portion of the screw boring into it. The diameter of the screw becomes progressively larger due to its taper, thereby causing the log to split.

In U.S. Pat. No. 3,993,113, Thackery discloses a log splitting apparatus for attachment to the powered wheel of a vehicle. The apparatus includes a base portion for removable attachment to the vehicle wheel, and an outer rotary end portion provided with a tapered auger for penetrating and splitting of logs. The auger includes a metal cone with a groove being spirally formed on the surface to form a large tapered screw. To the large end of this screw or head of the unit is fastened axially a shaft of suitable material and length. The shaft terminates in an adapter, which enables the entire assembly to be affixed to the hub center of any driving wheel, power take off shaft or other rotating power source on tractors, automobiles, pickup trucks, van vehicles, sports cars, and light and heavy duty trucks. The device is attached to the driving wheel, by means of axle hub bolts or wheel lug bolts and is quickly and easily mountable and demountable without necessary alteration of the vehicle parts.

Thackery, in U.S. Pat. No. 4,026,337, describes a power tool driven by a vehicle wheel hub. The tool includes a removable mounting means, which comprises a plurality of lug extenders adapted for removal attachment to the existing lugs, which normally retain the wheel on the vehicle. The lug extenders are arranged to utilize existing lug bolt nuts, such that they are universally adaptable to various models of vehicle sizes and configurations. The power log splitting device includes a shank portion with an outer piercing end and an inner base portion and an inner base plate provided with a plurality of mounting holes. The lug extenders include an inner end connected to a lug on a vehicle hub and an outer end provided with a detachable threaded bolt and nut arrangement for removably securing the mounting plate of the tool to the outer end of the lug extender.

In U.S. Pat. No. 4,188,987, James discloses an attachment powered by the power head of a chain saw. The attachment includes a housing with a chain reduction connected between the chain saw sprocket and an output shaft. The shaft itself is splined over a section of the exposed surface, terminating at the free end in a tapered screw, which, at its apex, is provided with a drill tip for forming the starting hole. Deployed on the splined section of the shaft is yet another tapered cone frustum, provided with exterior threads of a higher pitch than the threads formed on the tapered screw. This frustum is separated from the tapered end screw by way of a spring and it is against this spring that the frustum is brought down by virtue of the thread differential. Included further is an anti torque wedge aligned adjacent the shaft, which opposes the split surfaces of the log, thus taking out the torque produced in the course of splitting.

U.S. Pat. No. 4,245,683 by Cedergren describes a protective contrivance for a wood splitting machine with a rotatable splitting element and a work table located under the splitting element. The work table is provided with a table plate which extends toward and under the splitting element. The splitting element is provided with a screw-like front end with a drill point. A drill point protecting element is arranged which swings away from a position, in which one portion of the element prevents the drill point from engaging strange objects, and back to the protective position. Preferably, the protective element is biased to the position in which the protective portion is in the protective position and is provided with a recess, the walls of which surround the tip in the protective position. The protective element extends up through a groove in the table plate from the spring biased swivel arm.

In U.S. Pat. No. 4,252,166, Kozicki discloses a device for splitting a log of wood or other material. The device includes a pair of similar augers of generally conical configuration disposed on spaced parallel axes, preferably to rotate in opposite directions. The augers are mounted as a convenient, manually portable unit in operative relation with a suitable power source, speed reduction unit and clutch. The device is suitable for home use, though it may be embodied in a gang of any desired number of augers for rail splitting or other application, for home or industrial use. In some instances, certain advantages of the device can be had with the tandem augers rotating in the same direction.

Radzik in U.S. Pat. No. 4,317,476 describes a portable wood splitting device powered by a self-propelled motor vehicle having driven wheels interconnected by a set of differential gears. The wood splitting device includes a pair of drive rollers driven by one of the vehicle wheels, with at least one ramp to enable the vehicle to drive onto the device. A set of gears and chains enables at least one roller to drive a horizontal shaft carrying a threaded conical wedge. Preferably, two such threaded conical wedges are driven by the set of rollers, along with removable stops for preventing log rotation and an electrical switch for disabling the vehicle engine. A speed reduction is included as part of the interconnecting gears and chains, enabling the engine of the vehicle to be operated at idling speed.

In U.S. Pat. No. 4,335,762, Reaume et al. disclose a log splitter attachment for a garden tiller, a unique bearing arrangement for the same, and the combination of a garden tiller and such an attachment. The attachment includes a rigid ground engaging base frame having means to support the tiller tine shaft of a garden tiller and a log to be split. Preferably, the base frame also supports the garden tiller itself when used with the log splitter attachment. An auger is mounted on a shaft adapted to slip over one end of the tiller tine shaft. The auger shaft is secured to the tiller tine shaft and supported in a bearing member, which is affixed to the base frame. The other end of the tine shaft is engaged within a spacer located in a corresponding bearing member and the spacer is attached to the tine shaft. Preferably, the bearing members for the tine shaft are slotted just enough to receive the tine shaft but not the auger shaft or spacer. These enter the bearing member axially thereof and cannot pass through the slots. The auger extends to one side of the base frame. A log holding member is fastened to the base frame and extends to the same side as the auger, being spaced from but parallel to such auger. When the tiller motor is actuated to drive the tiller tine shaft, the auger and auger shaft rotate therewith. The operator then moves a log, supported at one end on the log support, into contact with the auger, whereby the auger screws itself into the log to split it open.

Schnebly, in U.S. Pat. No. 4,425,950, describes a log splitting apparatus having a rotatably driven splitter cone extending forward from a housing. A horizontal stabilizer base assembly extends forward from the bottom of the housing. The apparatus, optionally, rests directly on the ground or indirectly on the ground through elevating blocks. The stabilizer base assembly includes a base plate at one side of the housing and a transverse torque arm extending to the other side of the housing. The base plate has a pivoted connection to the one side of the housing about an axis extending substantially parallel to that of the splitter cone and is positioned to engage a log being pierced by the splitter cone, enabling the base plate to absorb torque reaction at the one side of the housing. The free end of the torque arm engages a support member extending forward from the opposite side of the housing to absorb additional torque reaction at that opposite side, thereby tending to neutralize any twisting or lifting forces applied thereto.

In U.S. Pat. No. 4,491,164, Waikas et al. disclose a portable impact driven log cone splitter mounted to a power source, such as a chain saw power unit. The wood or log splitter is coupled to a chain saw power unit through an appropriate gearing arrangement. The blade is removed from the conventional power saw unit, and the wood splitter is readily mounted thereto in an orientation having a hollow splitting screw cone with a starter tip parallel to the longitudinal axis of the unit. The cone is mounted over an impact drive unit, which is coupled to the gearing arrangement to provide a safe reliable drive. This arrangement also provides a portable log splitting unit, which is relatively inexpensive and simple to use and, with the cone removed, permits use as an impact tool.

Maingueneau, in U.S. Pat. No. 4,553,576 describes a log splitter having a rotatable cone driven by a reversible motor. A system of lever arms supports a log in a V-shaped carrier positioned under the point of the cone. When the lever arm is operated, the log is pushed against the point of the rotating cone, which splits the log. If the log fails to split, the motor is driven in the reverse direction, which releases the log. The rotatable cone, log and V-shaped carrier are all contained within a safety enclosure.

In U.S. Pat. No. 4,898,220, Maingueneau discloses another wood splitting machine having a rotating threaded cone, a longitudinal wedge disposed under the cone, and a table on top of which the log to be split is placed in front of the cone and wedge. The table top is rigid and the wedge is firmly fixed both to the rigid table top and to the bearing of the rotating shaft of the rotating threaded cone. The rigid top is fabricated of a plywood plate whose upper side is covered with sheet metal. A speed reducer is provided between the drive motor and the rotating shaft of the threaded cone. The speed reducer is an intermediary pinion whose bearing is also fixed to the wedge. The upper profile of the wedge has the same shape as the generator of the rotating threaded cone up to a short distance from the point thereof.

Lantz, in U.S. Pat. No. 6,408,907, describes a wood splitting attachment primarily for use with a skid steer loader that allows the wood splitter to be operated in the horizontal or vertical mode. The wood splitting attachment is connected to a skid steer loader, and the hydraulic fluid power source is mounted on the skid steer loader. The wood splitting attachment, including the wood supporting means, splitting wedge means and hydraulic means, has connecting means, preferably a mounting plate attached to the wood supporting means. Hydraulic lines are attached to the skid steer loader hydraulic system and the skid steer loader is connected to the log splitting attachment by means of the mounting plate. In order to give the wood splitter attachment stability in operation, support legs are rigidly connected between the posts and the mounting plate.

In U.S. Pat. No. 6,520,226, Smith discloses a wedge section of a skid steer loader coupling device which is received in a lip section of a log splitting system coupling device. A body section of the skid steer loader coupling device is urged into a flush position with a body section of a log splitting system coupling device. Levers on the skid steer loader coupling device are actuated from a first position to a second position, so that pin devices coupled to the levers move from a disengaged to an engaged position with respect to apertures in the log splitting system coupling device. Hoses are coupled at a first end of the log splitting system and at a second end of the skid steer loader. The skid steer loader is maneuvered proximately a first one of the logs to be engaged from above the log. A pushing mechanism is actuated to push a first end of the log with a pushing device a predetermined amount so that a second end of the log interacts with a cutting device sufficiently to engage the log. The pushing mechanism is actuated until the engaged log is split.

Machkovech, in U.S. Pat. No. 6,609,547, describes a log splitter that is interchangeably mounted to a skid loader in the same manner as conventional attachments. The skid loader longitudinal axis and the log splitter longitudinal axis are perpendicular. The log splitter has a mounting frame, an H-beam connected to the mounting frame, and a piston assembly and blade connected to the H-beam. The mounting frame has a top lip and a bottom flange. The skid loader has an attaching mechanism that engages the top lip and bottom flange of the mounting frame. The skid loader may supply power to the log splitter, so that the piston assembly pushes the head toward the blade. A user controls the orientation of the attaching mechanism and, hence the log splitter. The log splitter can pick a log off the ground, the skid loader can move while holding a log, and the log splitter can split a log over a receptacle.

In U.S. Pat. No. 6,763,864, Setlack et al. disclose a log splitter attachment for splitting logs on a loader that includes a pair of lift arms for supporting a bucket. The attachment comprises a frame supporting a blade and a log pusher thereon for sliding movement relative to one another and an actuator acting between the blade and the log pusher. The frame mounts on respective free ends of the lift arms of the loader in place of the bucket of the loader. The blade and log pusher is maneuvered over the top a log on the ground to split the log there between using the lift arm and bucket controls of the loader.

Stone, in U.S. Pat. No. 7,066,223, describes a hydraulic log splitter attachment for a skid steer loader. The splitter attachment includes a mounting framework attached to a vertical, elongated beam. A piston/cylinder combination with a rod mounts to the beam and moves between retracted and downwardly extended configurations. A wedge attaches to a lower end of the rod. A base plate attaches to the beam adjacent the lower end. Storage wall assemblies and stabilizing plates are attached to the base plate. Hoses connect the piston/cylinder combination to the loader's hydraulic system. Wedge guides slidably attach the wedge to the beam. The wedge guides include wedge guide rollers. The wedge optionally includes wedge rollers. The loader secures to the mounting framework. Wood is placed on the base plate while the rod is in the retracted configuration. The rod moves to the downwardly extended configuration, thus splitting the wood with the wedge. The storage wall assemblies provide split wood storage.

Applicant has devised an hydraulically implement attachment in the form of a powered wood splitting attachment for a powered machine that overcomes many of the shortcomings of the above wood splitting devices and allows an individual to use the hydraulically powered wood splitting attachment in a safe, comfortable manner.

SUMMARY OF THE INVENTION

The invention is directed to a hydraulically powered implement attachment for a powered machine. The implement attachment includes a frame member adapted for attachment to at least one movable arm of the powered machine. A reversible drive hydraulic motor member is mounted to the frame member, the hydraulic motor member including a drive shaft extending therefrom. The hydraulic motor member includes a pair of hydraulic power lines adapted for attachment to the powered machine. A power shaft is rotatably mounted to the frame member and operatively connected at a first end to the drive shaft of the hydraulic motor member. A rotationally operative implement member is connected to a second end of the power shaft. An operator of the powered machine actuates the rotationally operative implement member through rotation of the power shaft by the reversible drive hydraulic motor.

In a preferred embodiment, the invention is an hydraulically powered wood splitting attachment in combination with a powered machine. The combination includes a powered machine having an hydraulic system and at least one movable arm member. A frame member is attached to the at least one movable arm of the powered machine. A reversible drive hydraulic motor member mounted to the frame member has a drive shaft extending therefrom. The hydraulic motor member includes a pair of hydraulic power lines attached to the hydraulic system of the powered machine. A power shaft is rotatably mounted to the frame member and operatively connected at a first end to the drive shaft of the hydraulic motor member. A rotationally operative implement member is connected to a second end of the power shaft. The implement comprises a conical splitting screw member having a pointed tip, a threaded, conical exterior surface and a shaft protruding opposite the pointed tip thereof. The protruding shaft comprises the power shaft rotatably mounted to the frame member and is operatively connected at a first end to the drive shaft of the hydraulic motor member. An operator of the powered machine actuates the conical splitting screw member to rotate in a first direction to drive the screw member into a section of wood for splitting, and actuates the conical splitting screw member to rotate in an opposite direction to release the screw member from a split section of wood, if needed.

DESCRIPTION OF THE EMBODIMENTS

Nomenclature

10 Hydraulically Powered Wood Splitting Attachment
15 Rotationally Operative Implement Attachment
17 Rotationally Operative Implement Member
20 Frame Member
30 Conical Splitting Screw Member
35 Pointed Tip of Screw Member
40 Threaded, Conical Exterior Surface of Screw Member
45 Shaft of Screw Member
50 Bearing Members
55 Shaft Drive Sprocket
60 Reversible Drive Hydraulic Motor Member
65 Drive Shaft of Hydraulic Motor Member
70 Motor Drive Sprocket of Hydraulic Motor Member
75 Hydraulic Power Lines of Hydraulic Motor Member
80 Continuous Chain Member
85 Direct Drive Coupling
90 Mixing Container Member
92 Open Top of Container Member
94 Closed Bottom of Container Member
97 Clamp Member
98 Power Take Off Shaft Member
99 Post Hole Auger Member
A Arms of Powered Machine
M Powered Machine
H Helical Anchor Member
P Pointed End of Anchor Member Construction The invention is an hydraulically implement attachment for a powered machine. The implement attachment comprises a frame member adapted for attachment to at least one movable arm of the powered machine. A reversible drive hydraulic motor member is mounted to the frame member. The hydraulic motor member includes a drive shaft extending therefrom and a pair of hydraulic power lines adapted for attachment to the powered machine. A power shaft is rotatably mounted to the frame member and operatively connected at a first end to the drive shaft of the hydraulic motor member. A rotationally operative implement member is connected to a second end of the power shaft. An operator of the powered machine actuates the rotationally operative implement member through rotation of the power shaft by the reversible drive hydraulic motor. Preferably the implement attachment is a conical wood splitter member and the powered machine is a skid steer.

Figure 1:
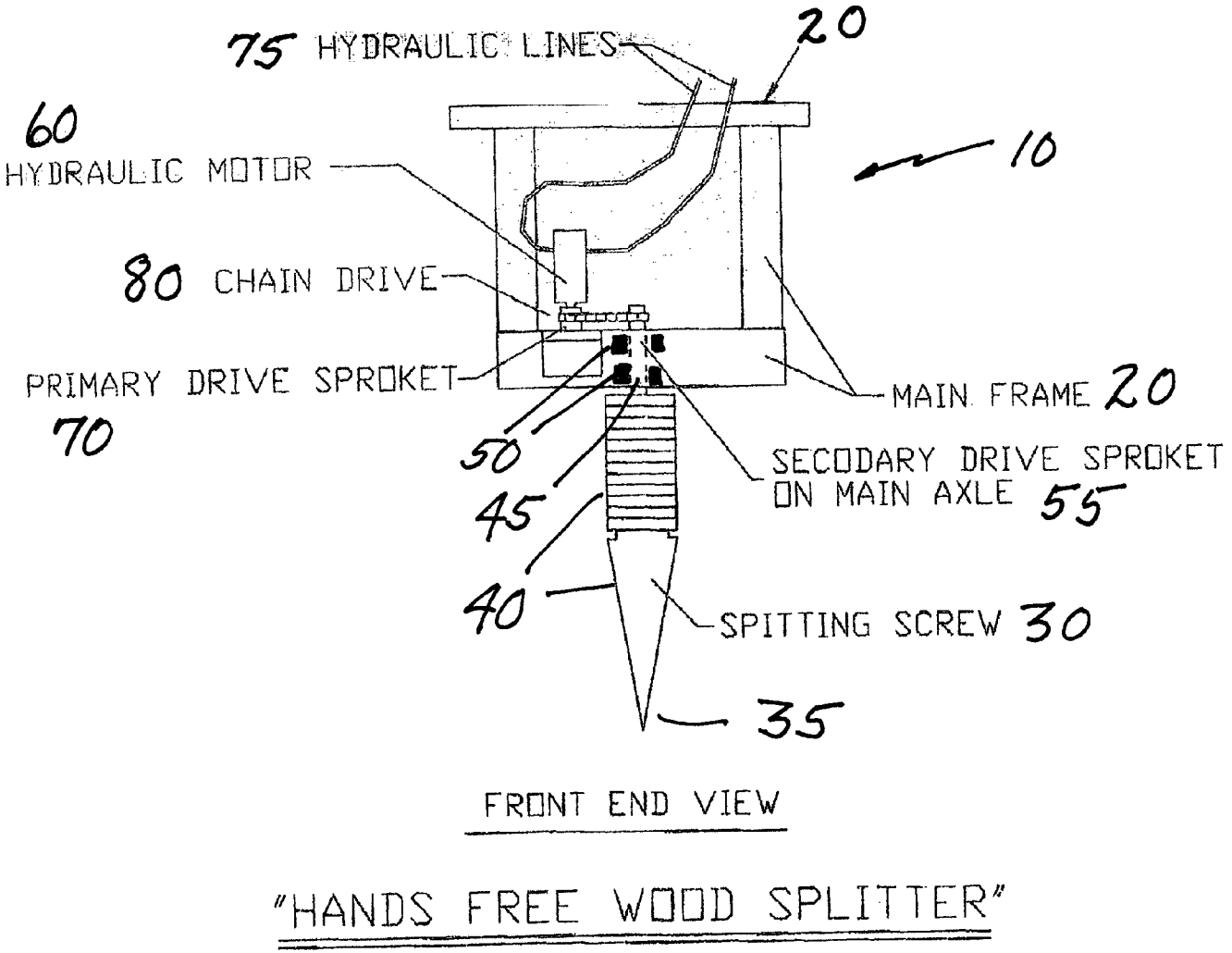
FIG. 1 is a perspective front view of the hydraulically powered wood splitting attachment of the present invention.

Referring now to FIG. 1, a first embodiment of the hydraulically powered wood splitting attachment 10 for a powered machine M is illustrated. The wood splitting attachment 10 comprises a frame member 20 adapted for attachment to at least one movable arm A of the powered machine M. A conical splitting screw member 30 has a pointed tip 35, a threaded, conical exterior surface 40 and a shaft 45 protruding opposite the pointed tip 35 thereof. The shaft member 45 is mounted to the frame member 20 by bearings 50, thereby allowing rotation of the shaft member 45 and attached conical splitting screw member 30 relative to the frame member 20. The conical splitting screw member 30 is oriented with the pointed tip 35 extending away from the frame member 20. In this embodiment, the shaft member 45 includes a shaft drive sprocket 55 attached thereto. A reversible drive hydraulic motor member 60 is also mounted to the frame member 20. The hydraulic motor member 60 includes a drive shaft 65 having a motor drive sprocket 70 attached thereto. The hydraulic motor member 60 also includes a pair of hydraulic power lines 75 adapted for attachment to the powered machine M. A continuous chain member 80 encircles the shaft drive sprocket 55 of the splitting screw member 30 and the motor drive sprocket 70 of the hydraulic motor member 60. An operator of the powered machine M actuates the conical splitting screw member 30 to rotate in a first direction to drive the splitting screw member 30 into a section of wood W for splitting and actuates the conical splitting screw member 30 to rotate in an opposite direction, if needed, to release the splitting screw member 30 from a split section of wood W.

Figure 2:
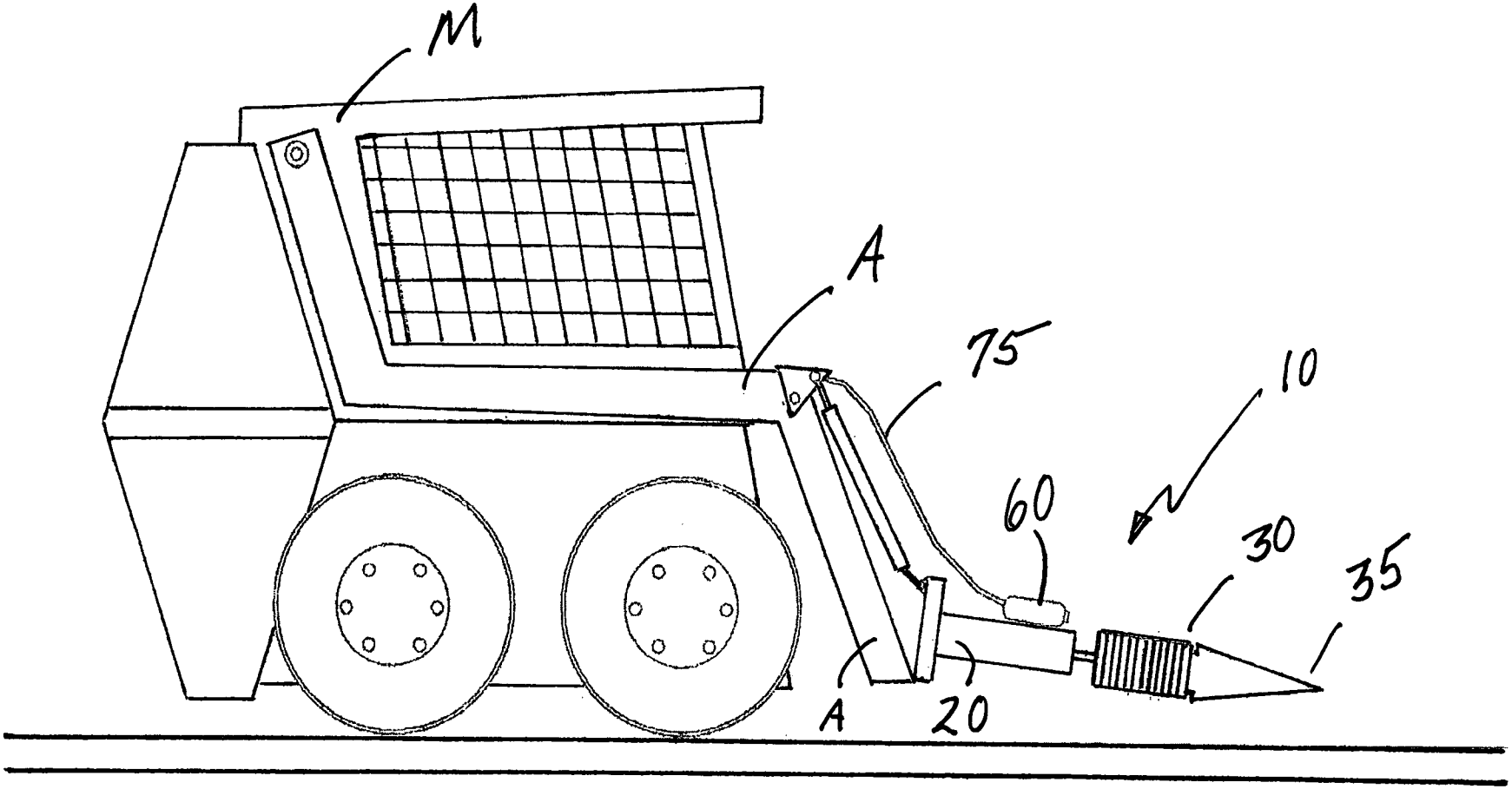
FIG. 2 is a perspective side view of the hydraulically powered wood splitting attachment of the present invention attached to a powered machine.
Figure 3:
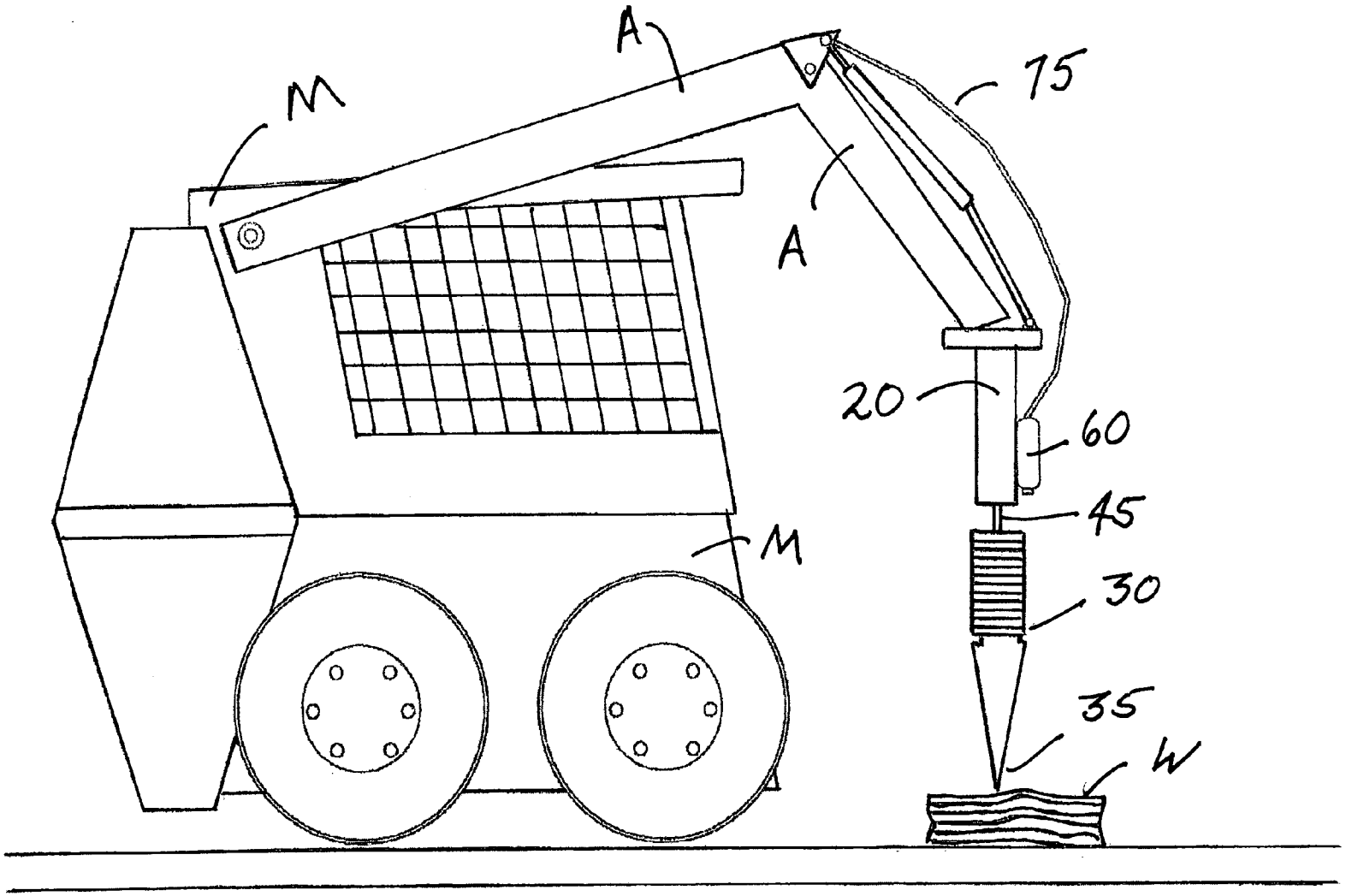
FIG. 3 is another perspective side view of the hydraulically powered wood splitting attachment of the present invention attached to a powered machine.

Referring now to FIGS. 2 and 3, side perspective views of the hydraulically powered wood splitting attachment 10 of the present invention, attached to a powered machine M, are shown. The powered machine M, in these illustrations, is a skid-steer machine M with a pair of hydraulically operated arms A. The hydraulic system of the skid-steer machine M powers both the operating arms A and the hydraulic motor member 60 secured to the frame member 20 of the hydraulically powered wood splitting attachment 10. Separate controls for the operating arms A and the hydraulic motor member 60 are provided for the operator, who is seated within the protective enclosure of the skid-steer machine M. Thus, as the operator moves the hydraulically powered wood splitting attachment 10 with the arms A of the skid-steer machine M to contact and split a section of wood W, he is completely protected from the splitting operation. The splitting of a section of wood W is depicted in FIG. 3. Alternatively, the powered machine M can include a backhoe, a tractor or even a walk behind machine, each of which separates the operator from the wood splitting attachment 10.

In addition, the operator can operate the hydraulically powered wood splitting attachment 10 to selectively rotate the conical splitting screw member 30 in either direction. The threaded, conical exterior surface 40 of the screw member 30 draws the screw member 30 into a section of wood W when rotated in one direction and withdraws the screw member 30 from the section of wood W when rotated in the opposite direction. Thus, a section of wood W that resists splitting can be disengaged from the screw member 30 without the operator leaving the protective enclosure of the powered machine M.

Figure 4:
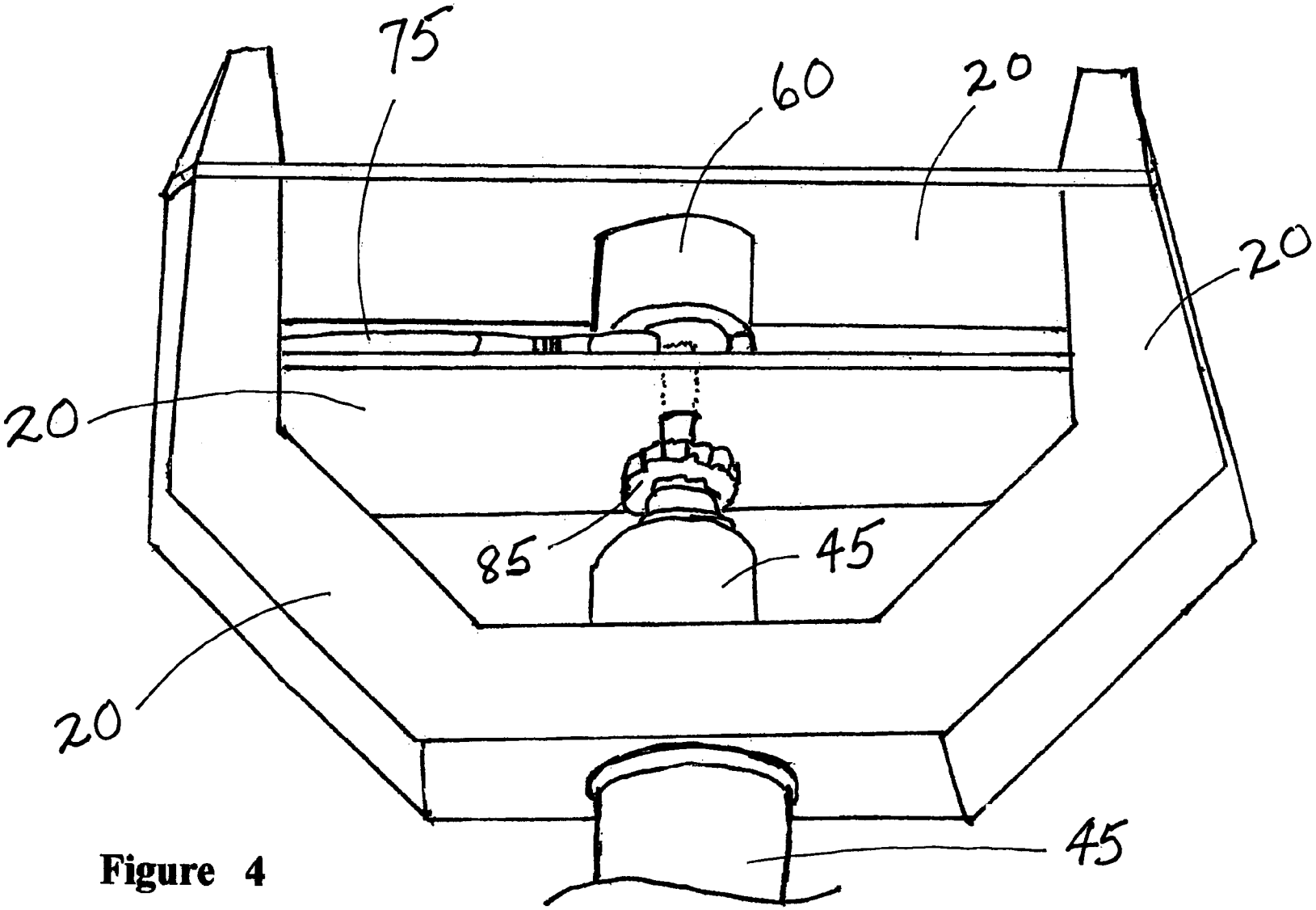
FIG. 4 is a perspective view of the hydraulically powered implement attachment employing a direct drive connection between the hydraulic motor and the power shaft of the present invention.
Figure 5:
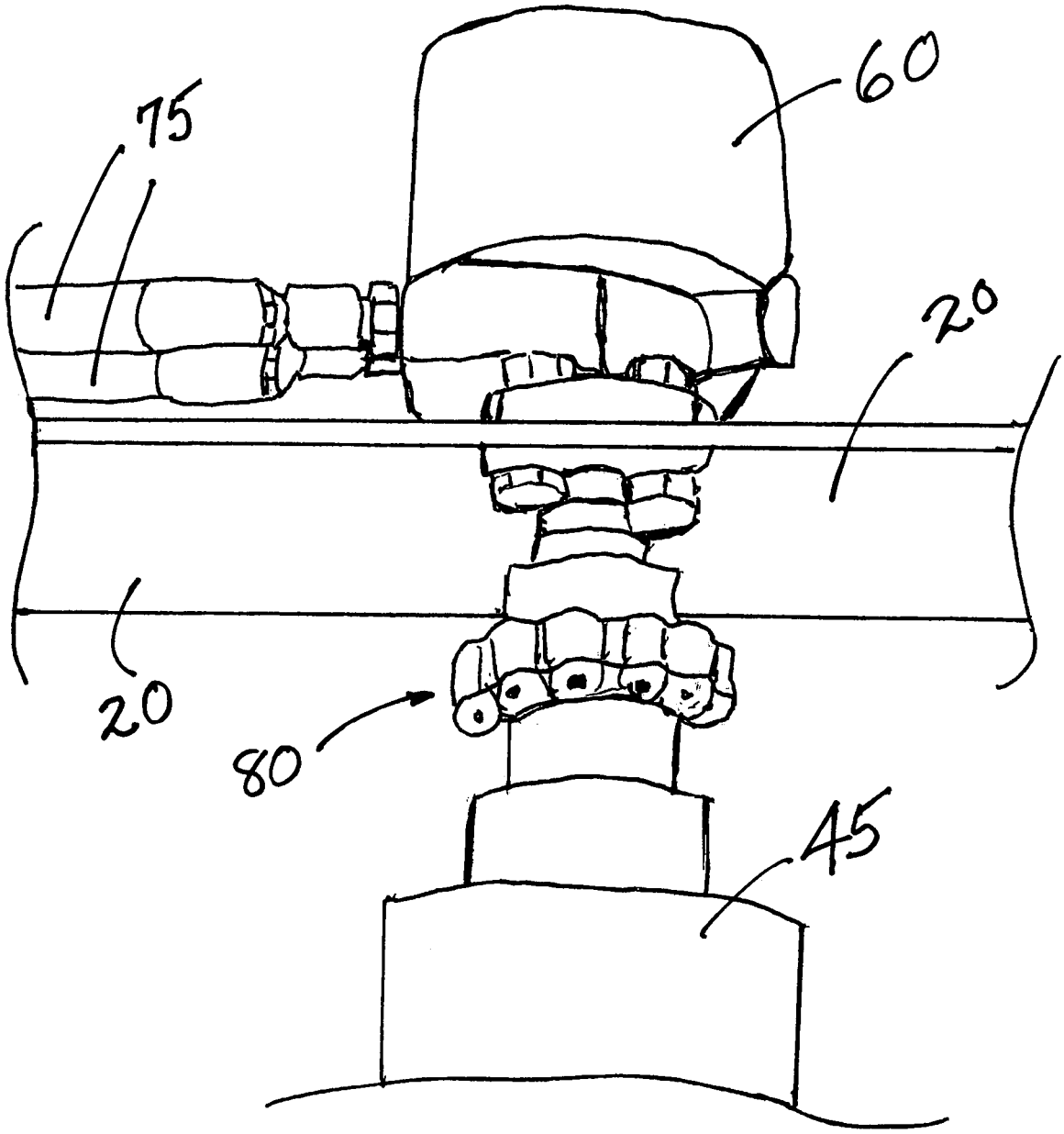
FIG. 5 is another perspective view of the hydraulically powered implement attachment employing a direct drive connection between the hydraulic motor and the power shaft of the present invention.

Referring now to FIGS. 4 and 5, a preferred embodiment of the drive mechanism for the hydraulically powered implement attachment 10 is shown. In this embodiment, the drive shaft 65 of the hydraulic motor member 60 is operatively connected to the power shaft 45 thereof by a direct drive coupling 85 for simplicity and durability.

In a further embodiment, the present invention includes a hydraulically powered implement attachment 15 operatively attached to a powered machine M. The combination comprises a powered machine M having an hydraulic system and at least one movable arm member A. A frame member 20 is attached to the at least one movable arm member A of the powered machine M. A reversible drive hydraulic motor member 60 is mounted to the frame member 20. The hydraulic motor member 60 includes a drive shaft 65 extending therefrom. The hydraulic motor member 60 also includes a pair of hydraulic power lines 75 operatively attached to the hydraulic system of the powered machine M for powering the motor member 60. A power shaft 45 is rotatably mounted to the frame member 20 and operatively connected at a first end to the drive shaft 65 of the hydraulic motor member 60. A rotationally operative implement member 17 is connected to a second end of the power shaft 45. An operator of the powered machine M actuates the rotationally operative implement member 17 through rotation of the power shaft 45 by the reversible drive hydraulic motor 60.

In one embodiment, the rotationally operative implement member 17 connected to a second end of the power shaft 45 comprises a conical splitting screw member 30 having a pointed tip 35, a threaded, conical exterior surface 40 and a shaft 45 protruding opposite the pointed tip 35 thereof. The protruding shaft 45 comprises the power shaft 45 rotatably mounted to the frame member 20 and operatively connected at a first end to the drive shaft 45 of the hydraulic motor member 60.

Figure 6:
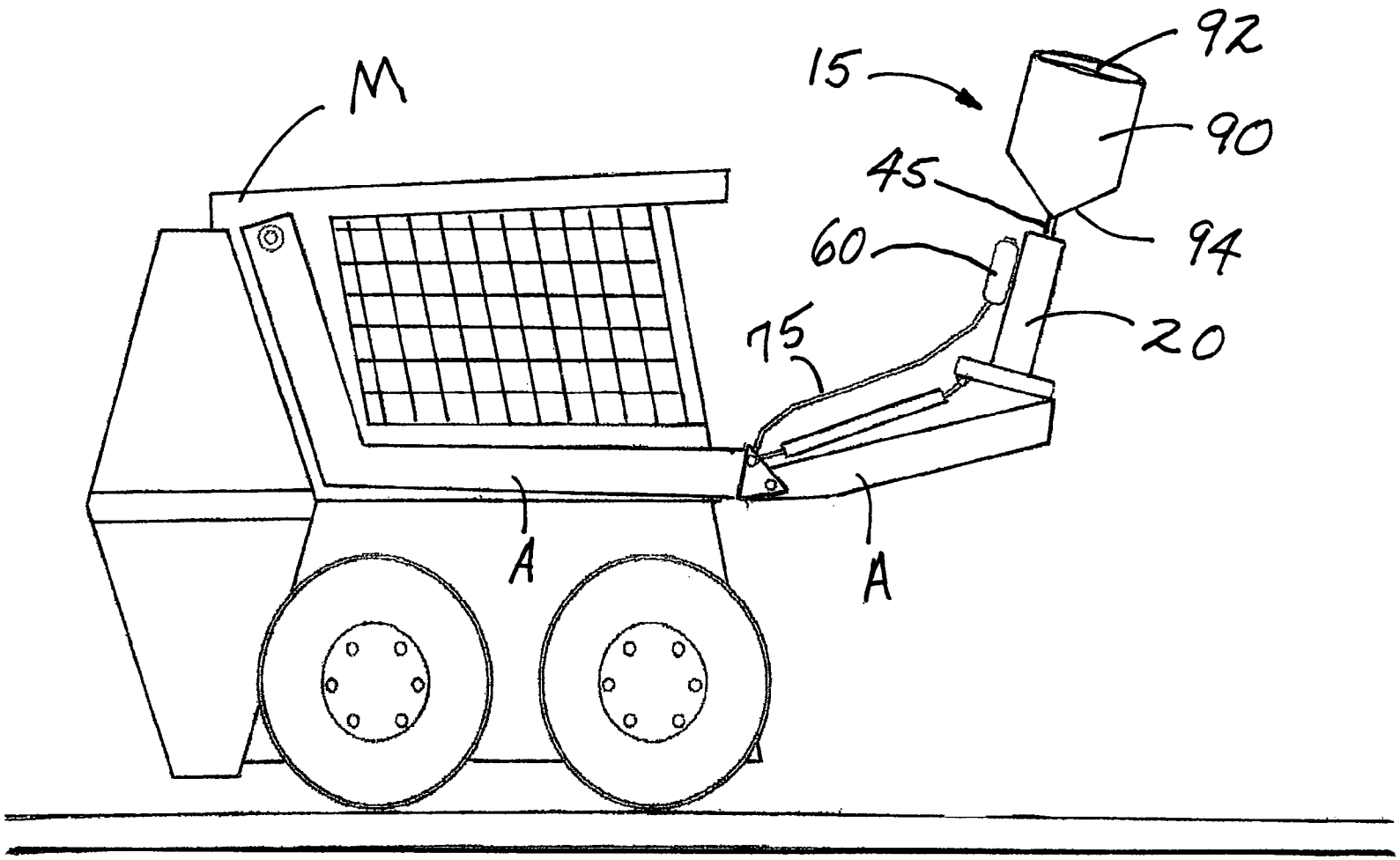
FIG. 6 is a perspective side view of the hydraulically powered implement attachment employing a mixing container and attached to a powered machine of the present invention.

In another embodiment, illustrated in FIG. 6, the rotationally operative implement member 15 connected to a second end of the power shaft 45 comprises a mixing container member 90 having an open top end 92 and a closed bottom end 94, the bottom end 94 operatively connected to the power shaft 45 for imparting rotational movement to the mixing container member 90. The mixing container member 90 may be used, for example, for mixing cement.

Figure 7:
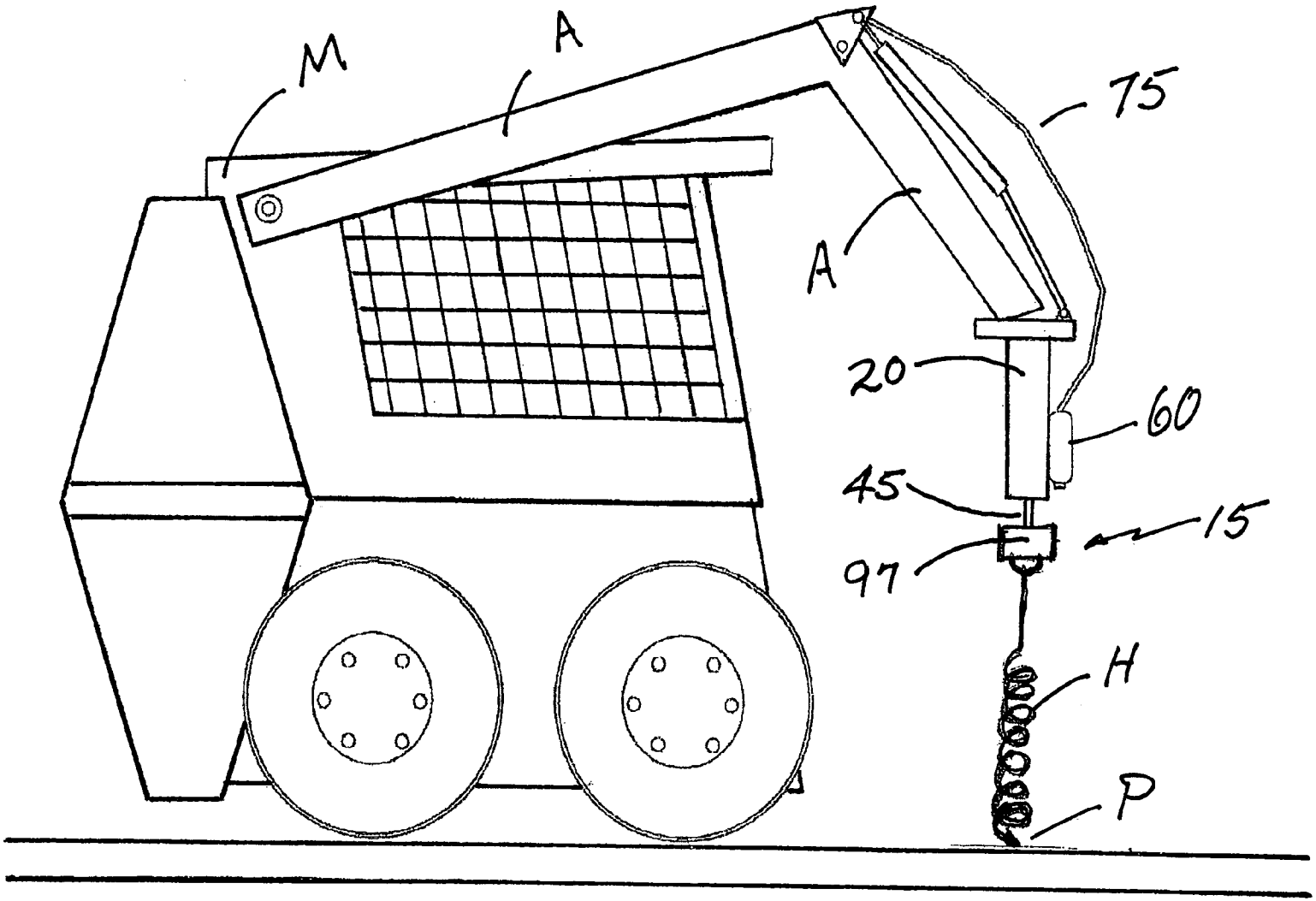
FIG. 7 is a perspective side view of the hydraulically powered implement attachment employing a clamping device and attached to a powered machine of the present invention.

In yet another embodiment, illustrated in FIG. 7, the rotationally operative implement member 17 connected to a second end of the power shaft 45 comprises a clamp member 97 adapted for releasable fastening to an end of a helical anchor member H opposite a pointed end P thereof, the clamp member 97 adapted for inserting the helical anchor member H into the earth by rotational movement thereof.

Figure 8:
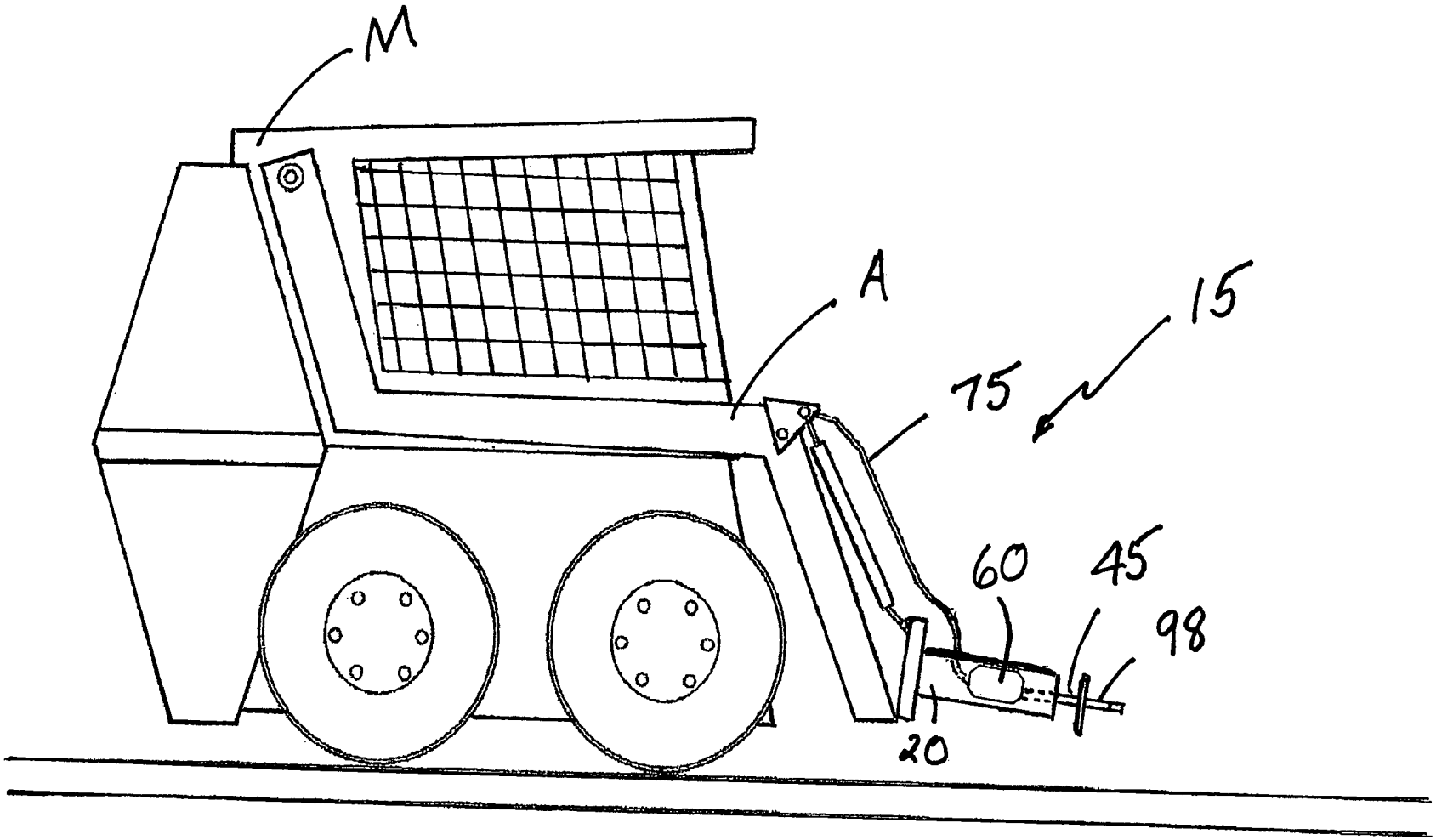
FIG. 8 is a perspective side view of the hydraulically powered implement attachment employing a power take off device and attached to a powered machine of the present invention.
Figure 9:
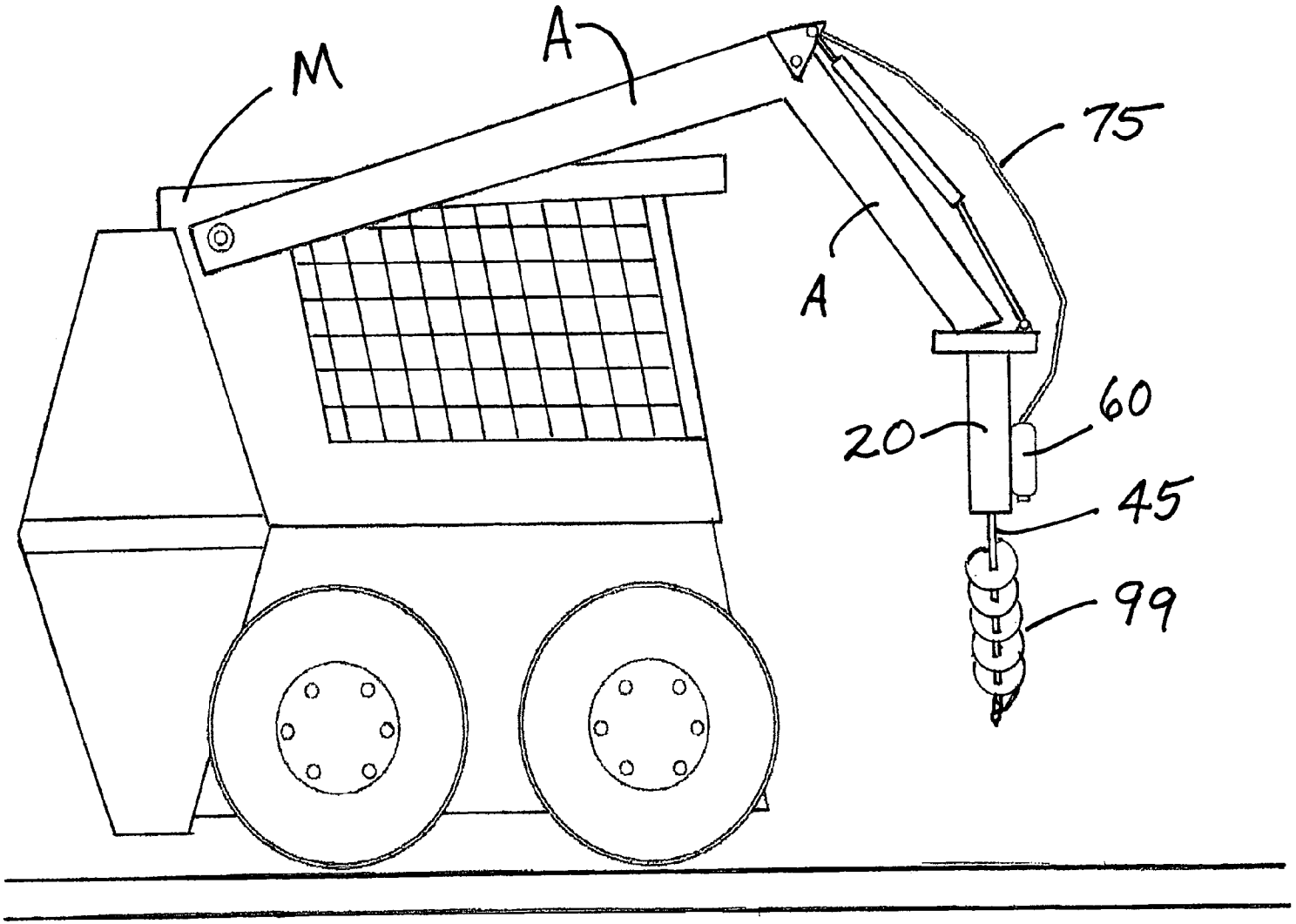
FIG. 9 is a perspective side view of the hydraulically powered implement attachment employing a post hole auger device and attached to a powered machine of the present invention.

In another embodiment, illustrated in FIG. 8, the rotationally operative implement member 17 connected to a second end of the power shaft 45 comprises a power take off shaft member 98 adapted for attachment to another implement and providing power thereto. In FIG. 9, the rotationally operative implement member 17 connected to a second end of the power shaft 45 comprises a post hole auger member 99 adapted for drilling a post hole in the earth.

While the invention has been particularly shown and described with reference to preferred embodiments thereof, it will be understood by those skilled in the art that various changes in form and details may be made therein without departing from the spirit and scope of the invention.

I claim:

1. A hydraulically powered wood splitting operatively attached to a powered machine comprising:

a powered machine having an hydraulic system and at least one movable arm member;

a frame member attached to the at least one movable arm of the powered machine;

a reversible drive hydraulic motor member mounted to the frame member, the hydraulic motor member including a drive shaft extending therefrom, the hydraulic motor member including a pair of hydraulic power lines attached to the hydraulic system of the powered machine;

a power shaft rotatably mounted to the frame member and operatively connected at a first end to the drive shaft of the hydraulic motor member; and a rotationally operative implement member connected to a second end of the power shaft, comprising a conical splitting screw member having a pointed tip, a threaded, conical exterior surface and a shaft protruding opposite the pointed tip thereof, the protruding shaft comprising the power shaft rotatably mounted to the frame member and operatively connected at a first end to the drive shaft of the hydraulic motor member;

whereby an operator of the powered machine actuates the conical splitting screw member through rotation of the power shaft by the reversible drive hydraulic motor.

2. The hydraulically powered wood splitting adapted for attachment for a powered machine of claim 1, wherein the drive shaft of the hydraulic motor member is operatively connected to the power shaft mounted to the frame member by a direct drive coupling.

3. The hydraulically powered wood splitting adapted for attachment for a powered machine of claim 1, wherein the drive shaft of the hydraulic motor member includes a motor drive sprocket attached thereto, the power shaft member includes a shaft drive sprocket attached thereto, and a continuous chain member encircles the motor drive sprocket and the shaft drive sprocket for operative connection there between.

4. The hydraulically powered implement operatively attached to a powered machine of claim 1, wherein the powered machine is selected from the group consisting of a skid steer, a backhoe, a tractor and a walk behind machine.

* * * * *